US007448953B2

(12) United States Patent
Chen

(10) Patent No.: US 7,448,953 B2
(45) Date of Patent: Nov. 11, 2008

(54) STRUCTURE OF A HORSE RIDING MACHINE

(76) Inventor: Chiu-Ku Chen, P.O.Box 44-2049, Taipei (TW) 10668

( * ) Notice: Subject to any disclaimer, the term of this patent is extended or adjusted under 35 U.S.C. 154(b) by 299 days.

(21) Appl. No.: 11/503,071

(22) Filed: Aug. 14, 2006

(65) Prior Publication Data

US 2008/0058110 A1 Mar. 6, 2008

(51) Int. Cl.
*A63G 17/00* (2006.01)

(52) U.S. Cl. ..... 472/96; 472/97; 472/59; 434/247; 434/55

(58) Field of Classification Search ..... 472/59, 472/95–97, 135; 482/51; 434/55, 247; 297/260.1, 297/260.2

See application file for complete search history.

(56) References Cited

U.S. PATENT DOCUMENTS 4,584,896 A * 4/1986 Letovsky ..... 74/490.1
4,749,180 A * 6/1988 Boomer ..... 482/51
5,180,338 A * 1/1993 Pinto ..... 472/96
6,039,653 A * 3/2000 Engstrand ..... 472/59
6,162,058 A * 12/2000 Yang ..... 434/55
6,445,960 B1 * 9/2002 Borta ..... 700/28
6,808,458 B1 * 10/2004 Jung ..... 472/97
6,866,594 B2 * 3/2005 Greenwood ..... 473/422
6,964,614 B1 * 11/2005 Tsai ..... 472/58
7,121,831 B2 * 10/2006 Hojo et al. ..... 434/247
7,201,709 B1 * 4/2007 Pebbles, Jr. ..... 482/95
7,338,413 B2 * 3/2008 Nakanishi ..... 482/51

* cited by examiner

*Primary Examiner*—Kien Nguyen
(74) *Attorney, Agent, or Firm*—C. G. Mersereau; Nikolai & Mersereau, P.A.

(57) ABSTRACT

The invention provides a structure of a horse riding machine and directs to a mechanism composed of a swinging device and a guiding device. The mechanism can produce the back-and-forth motion, the swinging motion, and the left-and-right and up-and-down motions and thus the 8-shaped motion. Thus, the effect of actually riding a horse can be obtained such that the horse riding machine having the effect of overall exercising the buttock, the waist and the leg and the body-shaping effect can be obtained.

3 Claims, 2 Drawing Sheets

STRUCTURE OF A HORSE RIDING MACHINE

BACKGROUND OF THE INVENTION (1) Field of the Invention

The invention relates to a structure of a horse riding machine, which is composed of a swinging device and a guiding device. The upper section of the shaft of the swinging device has an inclined eccentric design, the disk body is rotated, the guiding device guides the guiding and restricting link and the support lever to be assembled with each other, and one end of the support lever is formed with a universal joint capable of rotating by 360 degrees. According to the above-mentioned structure, when the motor rotates the rotating assembly, the disk body assembled on the rotating assembly is rotated therewith. Because the shaft of the swinging device is shifted with the rotation of the disk body, the support lever of the guiding device is forced to push the guiding and restricting link to move back and forth. According to the rotation of 360 degrees of the pivoting head, the shaft of the swinging device is moved in an 8-shaped manner, and a back-and-forth motion, a back-and-forth swinging motion, and left-and-right and up-and-down swing motions are produced. In addition, adjusting the adjusting screw at the front end of the support lever can change the swinging amplitude. Thus, the effect of actually riding a horse can be produced, and the effect of overall exercising the buttock, the waist and the leg and the body-shaping effect can be obtained.

(2) Description of the Prior Art

Exercise equipment may have different forms and types according to the parts of exercise and fitness. Because there are many types, detailed descriptions and comparisons cannot be made here. The typical horse riding machine is restricted by the 8-shaped motion toward two sides or the back-and-forth motions, and can only exercise a single part of the user's body, but cannot effectively exercise all part of the body. Thus, the flexibility in usage is restricted, and the economic effectiveness cannot be satisfied. In addition, the back-and-forth motion of the machine provides too-large forces of vibration such that the waist or the vertebra may be hurt, or the elder user tends to be hurt easily. Thus, the conventional horse riding machine has to be improved.

SUMMARY OF THE INVENTION

The drawbacks of the conventional horse riding machine cannot be effectively improved such that the fitness equipment is good but not ideal. In view of this, the inventor of the invention makes great research and development to invent this invention.

Accordingly, a main object of the invention is to provide a horse riding machine composed of a swinging device and a guiding device. The swinging device is composed of a shaft, a disk body and a U-shaped seat. An upper section of the shaft tilts eccentrically toward a center of the shaft. The disk body and a rotating assembly are assembled together. An upper section of the shaft of the swinging device is placed in a fitting block of the U-shaped seat. A lower section of the shaft of the swinging device is placed in a shaft hole of the disk body. The U-shaped seat of the swinging device serves as a connection between the shaft of the swinging device and a seat cushion. The upper section of the shaft of the swinging device has the shape tilting toward the center. So, when a motor rotates the rotating assembly, the disk body assembled on the rotating assembly is rotated therewith. Because the shaft of the swinging device is shifted with the rotation of the disk body, the shaft of the swinging device can be moved in an 8-shaped manner.

Accordingly, another object of the invention is that a guiding device is composed of a guiding and restricting link and a support lever. One end of the guiding and restricting link is connected to a pivoting seat. The pivoting seat is fixed on a base. The other end of the guiding and restricting link is formed with a pivoting end. One end of the support lever is formed with a universal joint capable of rotating by 360 degrees. The universal joint at the front end of the support lever of the guiding device is pivoted on the pivoting end at the front end of the guiding and restricting link. So, when the motor rotates the rotating assembly to make the disk body rotate therewith, the shaft of the swinging device is shifted with the rotation of the disk body, and the support lever of the guiding device is forced to push the guiding and restricting link to produce the back-and-forth motion. In addition, the left-and-right and up-and-down swinging motions are produced according to the rotation of 360 degrees of the pivoting head. Thus, the overall machine produces the back-and-forth motion, the swinging motion, and the left-and-right and up-and-down swinging motions are produced, and the 8-shaped motion is simultaneously produced. Thus, the effect of actually riding a horse can be produced, and the effect of overall exercising the buttock and the waist can be obtained.

Accordingly, another object of the invention is to dispose an adjusting screw between the universal joint at the front end of the support lever and the support lever. Adjusting the adjusting screw at the front end of the support lever can change the swinging amplitude.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
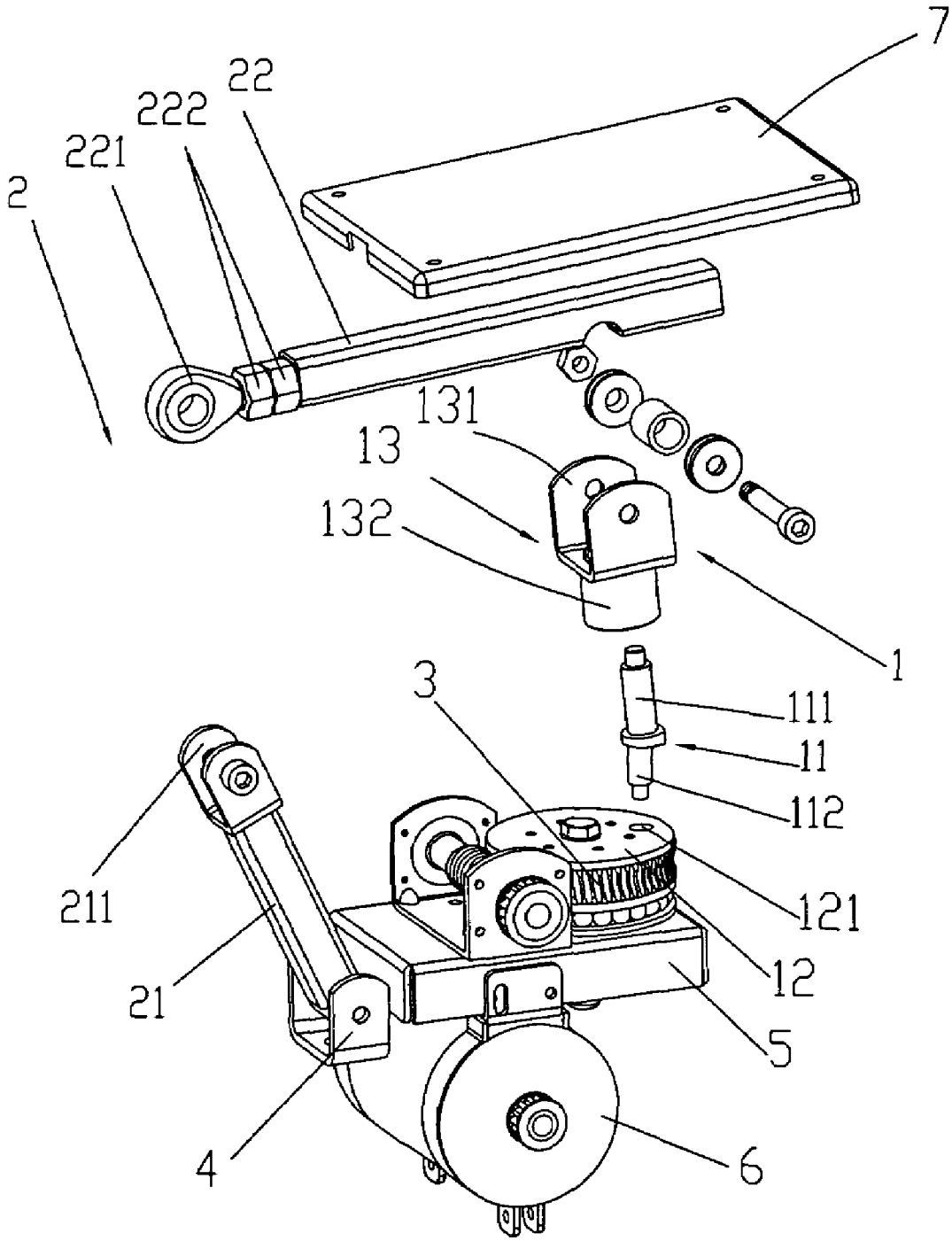
FIG. 1 is a pictorially exploded view showing an embodiment of the invention.
Figure 2:
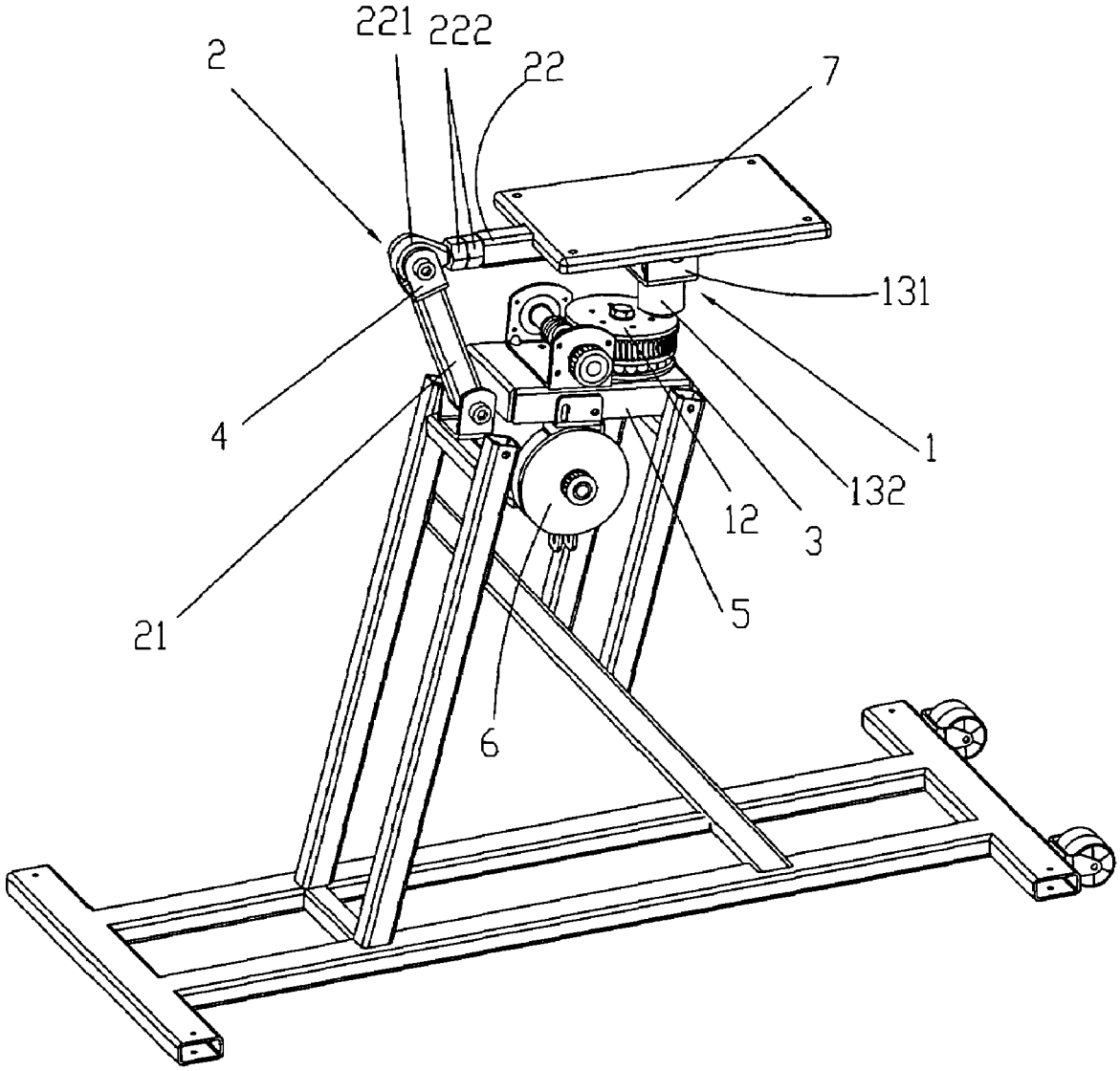
FIG. 2 is a pictorially assembled view showing the embodiment of the invention.

FIG. 1 is a pictorially exploded view showing an embodiment of the invention. As shown in the drawing, the structure of the horse riding machine of the invention is mainly composed of a swinging device 1 and a guiding device 2. The swinging device 1 is composed of a shaft 11, a disk body 12 and a U-shaped seat 13. An upper section 111 of the shaft 11 is eccentric and tilts toward the center of the shaft. The disk body 12 is formed with a shaft hole 121 and combined with a rotating assembly 3. The guiding device 2 is composed of a guiding and restricting link 21 and a support lever 22. One end of the guiding and restricting link 21 is connected to a pivoting seat 4, which is fixed to a base 5. The other end of the guiding and restricting link 21 is formed with a pivoting end 211. One end of the support lever 22 is formed with a universal joint 221 capable of rotating by 360 degrees. An adjusting screw 222 is disposed between the universal joint 221 and the support lever 22. According to the above-mentioned structure, the machine can be assembled as shown in FIG. 2, which is a pictorially assembled view showing the embodiment of the invention. As shown in FIG. 2, the upper section 111 of the shaft 11 of the swinging device 1 is placed in a fitting block 132 of the U-shaped seat 13, and a lower section 112 of the shaft 11 of the swinging device 1 is placed in the shaft hole 121 of the disk body 12. The U-shaped seat 13 of the swinging device 1 serves as a connection between the shaft 11 of the swinging device 1 and a seat cushion 7. The universal joint 221 at the front end of the support lever 22 of the guiding device 2 is pivoted on the pivoting end 211 at the front end of the guiding and restricting link 21. The upper section 111 of the shaft 11 of the swinging device 1 has the shape tilting toward the center of the shaft. So, when a motor 6 rotates the rotating assembly 3, the disk body 12 assembled onto the rotating assembly 3 is rotated therewith. Because the shaft 11 of the swinging device 1 is shifted with the rotation of the disk body 12, the support lever 22 of the guiding device 2 is forced to push the guiding and restricting link 21 to move back and forth. In addition, the back-and-forth swinging and displacing operations are produced by the rotation of 360 degrees of the pivoting head. Thus, the shaft 11 of the swinging device 1 is moved in an 8-shaped manner and swung back and forth and up and down. Also, adjusting the adjusting screw 222 at the front end of the support lever 22 can change the swinging amplitude. Thus, the effect of actually riding a horse can be achieved, and the horse riding machine having the effect of overall exercising the buttock, the waist and the leg and the body-shaping effect can be obtained.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A structure of a horse riding machine, which is mainly composed of a swinging device and a guiding device,-characterized in that:

the swinging device is composed of a shaft, a disk body and a U-shaped seat, the shaft has an upper section eccentrically tilting toward a center of the shaft, and the disk body is formed with a shaft hole and is assembled with a rotating assembly;

the guiding device is composed of a guiding and restricting link and a support lever, one end of the guiding and restricting link is formed with a pivoting end, and one end of the support lever is formed with a universal joint capable of rotating by 360 degrees; and when the structure is being assembled, the upper section of the shaft of the swinging device is placed in a fitting block of the U-shaped seat, a lower section of the shaft of the swinging device is placed in the shaft hole of the disk body, the U-shaped seat of the swinging device serves as a connection between the shaft of the swinging device and a seat cushion, the universal joint at a front end of the support lever of the guiding device is pivoted on the pivoting end of the guiding and restricting link, and the upper section of the shaft of the swinging device has a shape tilting toward the center such that the shaft of the swinging device is moved in an 8-shaped manner, and a back-and-forth motion, a back-and-forth swinging motion, and left-and-right and up-and-down swing motions are produced.

2. The structure of the horse riding machine according to claim 1, wherein the guiding and restricting link is fixed to a pivoting seat and the pivoting seat is also fixed to a base, the one end of the guiding and restricting link is formed with the pivoting end, and the one end of the support lever is connected to the universal joint.

3. The structure of the horse riding machine according to claim 1, wherein an adjusting screw is disposed between the universal joint and the support lever.

* * * * *